United States Patent [19]

Towsend

[11] 4,153,287

[45] May 8, 1979

[54] SHOVEL BLADE

[76] Inventor: Marvin S. Towsend, 1365 Potomac Hts. Dr., Oxon Hill, Md. 20022

[21] Appl. No.: 874,816

[22] Filed: Feb. 3, 1978

[51] Int. Cl.[2] ..... A01B 1/20

[52] U.S. Cl. ..... 294/51; 37/53; 15/111

[58] Field of Search ..... 294/51, 54; 37/53; 30/169, 280; 15/111

[56] References Cited

U.S. PATENT DOCUMENTS

| | | | |
|---|---|---|---|
| 634,578 | 10/1899 | Kaucher | 37/53 |
| 634,963 | 10/1899 | Smith | 37/53 |
| 877,614 | 1/1908 | Thompson | 294/51 |
| 1,143,752 | 6/1915 | Crisman | 15/111 |

*Primary Examiner*—James B. Marbert

[57] ABSTRACT

A shovel blade used for clearing snow and ice from walkways, road surfaces, and the like having semirigid bristles projecting from the lower surface of the shovel blade.

11 Claims, 5 Drawing Figures

SHOVEL BLADE

FIELD OF THE INVENTION

The invention here presented is broadly in the art of devices for shoveling snow and ice. More specifically, it is in the art of shovel blades used primarily for clearing snow and ice from walkways, road surfaces, and the like.

BACKGROUND OF THE INVENTION

The prior art of snow shovels, shovel blades, and the like shows various implements for clearing snow and ice from surfaces. One type of device employs teeth for cutting ice; the teeth are stamped out of the body of the shovel blade. Another device employs a broom in combination with a shovel; both broom and shovel are independently attached to a common handle. Another device employs wheels fixed to the outer sides of the shovel blade; the wheels keep the leading edge of the shovel blade a predetermined distance from the surface to be cleaned.

It is an object of the invention herein disclosed to provide a novel shovel blade having an attached set of semirigid bristles, disposed a suitable distance behind the leading edge of the blade which serve the multiple functions of, first, controlling the angle of attack of the leading edge of the blade with respect to the surface being cleared; second, scraping snow and ice by virtue of the semirigid character of the bristles; and, third, chopping ice when raised and lowered perpendicularly to the surface to be cleared.

A further objective of the invention is to provide a novel hand-held shovel incorporating the novel shovel blade of the invention.

Another objective of the invention is to provide a novel shovel blade having an attached set of semirigid bristles adjacent to the leading edge of the shovel blade which serve the multiple functions of, first, preventing the leading edge of the shovel blade from coming too close to the surface to be cleared so as not to be blocked or damaged by small surface irregularities; second, allowing the leading edge of the blade to effectively ride over small surface irregularities; and, third, to scrape the surface to be cleaned.

Another objective of the invention is to provide a machine-mounted shovel blade such as used on automotive snow plowing apparatus incorporating the novel shovel blade of the invention.

These and other objectives are accomplished by the invention as described below.

SUMMARY OF THE INVENTION

A shovel blade is affixed with semirigid bristles which project from the lower surface of the blade. When the semirigid bristles are disposed a suitable distance behind the leading edge of the shovel blade, they serve to control the angle of attack of the leading edge of the shovel blade with respect to the surface to be cleared and thereby serve to prevent the leading edge from being damaged by small irregularities in the surface which is being cleared. The semirigid bristles also serve to scrape ice and snow. In addition, the semirigid bristles serve as choppers when the shovel blade is raised and lowered with respect to the surface to be cleared.

When the semirigid bristles are affixed to the shovel blade adjacent to the leading edge of the blade, then they prevent the leading edge from being blocked by small surface irregularities; and the bristles allow the leading edge of the blade to effectively ride over small surface irregularities.

The novel features characteristic of the invention as to its organization and applications will best be understood when read in connection with the accompanying drawing.

DESCRIPTION OF THE DRAWING

FIGS. 3 and 4 are side views. FIG. 5 is a rear view.

DETAILED DESCRIPTION OF THE INVENTION

Figure 1:
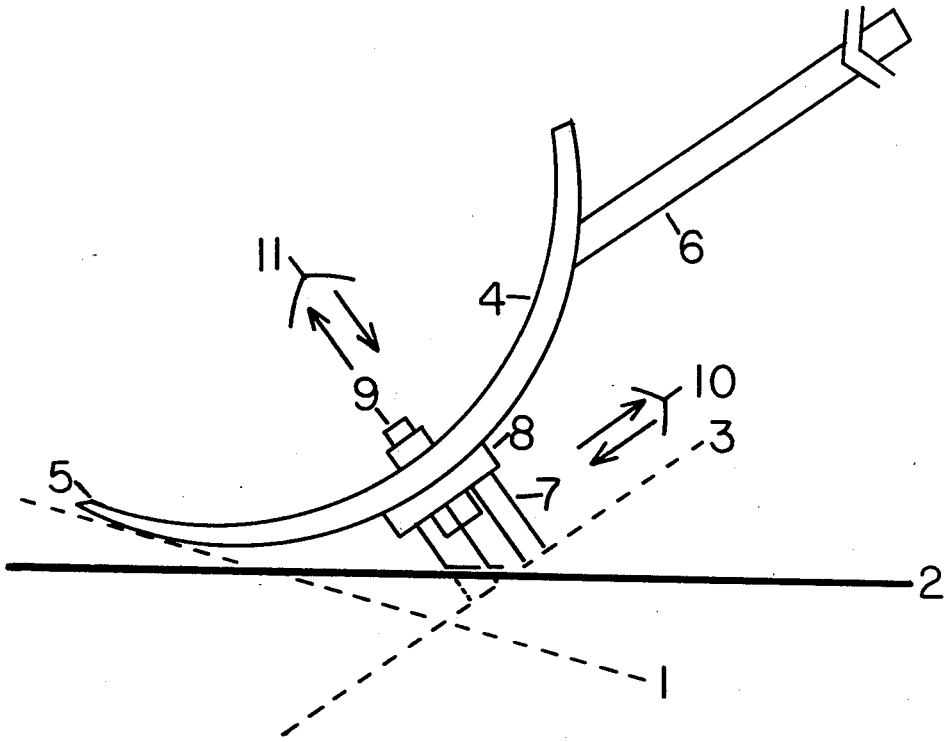
FIG. 1 shows a side view of an embodiment of the invention wherein the semirigid bristles are located a suitable distance behind the leading edge of the shovel blade. Three horizontal reference lines are provided to illustrate the invention positioned at three different orientations with respect to an actual horizontal surface in practice.

In FIG. 1, shovel blade 4 is shown with its leading edge 5 in contact with horizontal reference line 1. A handle 6 is attached to the shovel blade. Semirigid bristles 7 are mounted in a wooden bristle holder 8 which is connected to shovel blade 4 through holes in the body of the bristle holder and the body of the shovel blade by bristle connecting means 9 which is shown as a nut and bolt. As shovel blade 4 is pushed back and forth by means of attached handle 6, the bristles 7 are not in contact with horizontal surface 1. In this orientation, the shovel blade functions like a typical prior art shovel not having the novel features of the invention.

Regarding horizontal reference line 2 as the actual horizontal, the shovel blade 4 has been tilted approximately fifteen degrees. Thereby, the bristles 7 are now in contact with horizontal surface 2. The leading edge 5 of the shovel blade 4 is now slightly above the horizontal surface 2. In this orientation, one improvement of the invention is evident. Since the leading edge 5 of the shovel blade 4 is elevated, it is not susceptible to being blocked by small irregularities in the horizontal surface 2. In actual usage, the horizontal surface 2 may take the form of a typical cement sidewalk. There are often differences in height between adjacent sidewalk segments. These height differences often impede a smooth shoveling action. Furthermore, they contribute significantly to the premature wear of the leading edge of the shovel blade.

Regarding the horizontal reference line 2 as the actual horizontal, the shovel blade 4 is in effect resting on the bristles 7 and not on the leading edge 5. The leading edge 5 thereby avoids slight surface irregularities in the horizontal surface 2 by being effectively higher than the surface irregularities. The angle of attack of the leading edge 5 is controlled by the bristles 7 which serve as a fulcrum of a first class lever whose left end is the leading edge 5, whose fulcrum is the effective point of contact between the bristles 7 and horizontal surface 2, and whose right end is the handle 6.

In this orientation, the bristles 7 serve a second function; namely, scraping the surface 2 as the shovel is pushed along the surface 2 back and forth. The bristles 7, preferably, are semirigid; that is, on the one hand, they are rigid enough to support the weight of the shovel and at the same time serve as an effective scraper. On the other hand, however, the bristles 7 must not be too rigid. They must be sufficiently flexible to yield to small irregularities in the horizontal surface 2, and they must bend so as to ride over the irregularities instead of being stopped by them. The steel wire bristles typically found in wire brushes having wooden bristle holders used for scraping rust from metal surfaces have been found to be satisfactory in an embodiment of the invention.

Regarding the horizontal reference line 3 as the actual horizontal, the shovel blade 4 has been tilted another approximately thirty degrees. Thereby, the orientation of the shovel blade 4 is such that bristles 7 are perpendicular to horizontal surface 3. In this orientation the bristles are most effective as scrapers when movement is back and forth, as indicated by arrows 10. In this orientation, the bristles 7 can serve another function. When moved up and down, as indicated by arrows 11, the bristles 7 serve as choppers. If desired, a separate chopper can be installed on the shovel blade along an intermediate line between the bristles and the handle.

Figure 2:
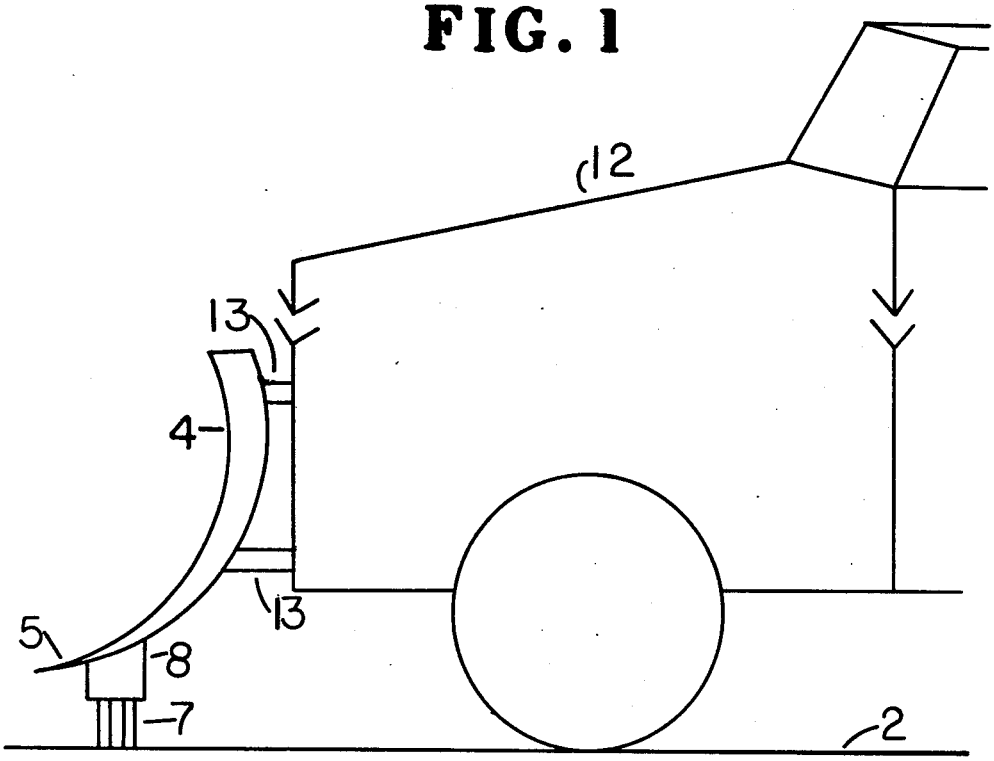
FIG. 2 shows an embodiment of the invention wherein the bristles are adjacent to the leading edge of the shovel blade.

In FIG. 2, a shovel blade 4 is attached to an automotive vehicle 12 by means of supports 13. A bristle holder 8 is affixed to the shovel blade 4 adjacent to the leading edge 5 of the blade. The semirigid bristles 7 project perpendicularly to the surface 2. If supports 13 are not movable vertically, then the bristles 7 serve as scrapers which yield to small surface irregularities. If supports 13 are movable vertically, then the shovel blade may float on the semirigid bristles 7; and the resultant action of the bristles will be to perform two functions simultaneously, first, to serve as a scraper which yields to small surface irregularities and, second, to serve as a floating support which rides over small surface irregularities.

In the various embodiments of the invention, several additional means for connecting the bristles to the shovel blade are available which have not been illustrated in FIGS. 1 and 2.

Figure 3:
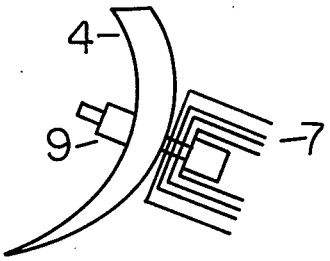
FIGS. 3, 4 and 5 show several additional means for connecting the bristles to the shovel blade.

In FIG. 3, bristles 7 are attached directly to shovel blade 4 by nut and bolt 9 through a hole in the body of shovel blade 4.

Figure 4:
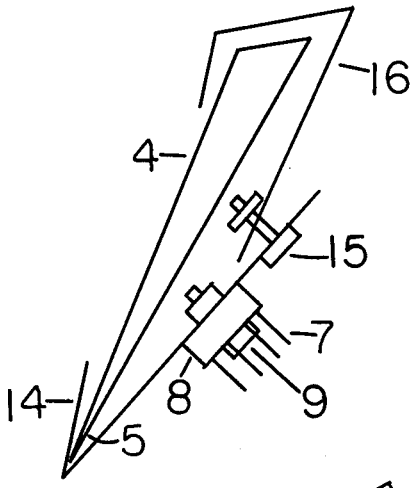

In FIG. 4, a first intermediate plate 14, having its forward end folded over the leading edge 5, fits snugly to the shovel blade 4. The rearward end of the first intermediate plate is clamped by clamping means 15, shown here as a nut and bolt, to the forward end of a second intermediate plate 16 whose rearward end is folded over and fits snugly to the trailing edge of shovel blade 4. A bristle holder 8 with its bristles 7 is attached by means of bristle connecting means 9, a nut and bolt, to the first intermediate plate 14 through a hole in the body of the intermediate plate. However, there is no hole made in the body of the shovel blade 4. Alternatively, though not illustrated, bristles 7 may be attached directly to the first intermediate plate 14 by nut and bolt 9.

Figure 5:
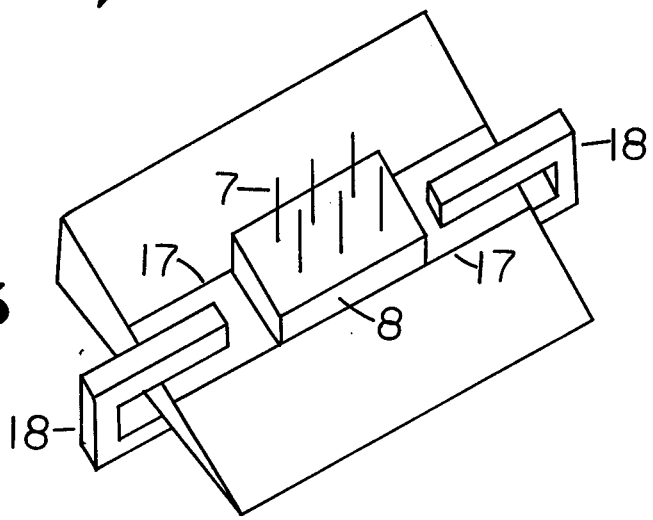

In FIG. 5, bristles 7 are attached directly or through a bristle holder 8 to a baseplate 17. The baseplate 17 is clamped to the shovel blade 4 by clamping means 18 at the outer sides of shovel blade 4. By clamping baseplate 17 to shovel blade 4 by means of clamps 18, no hole is made in the body of the shovel blade 4.

Another means for connecting the bristles to the shovel blade is a track connected to the shovel blade. A bristle holder would be shaped to slide along the track into position. A replacement bristle holder having new bristles could be installed easily in the track from which a bristle holder having worn bristles could easily be removed.

The bristles used in the invention can take a variety of forms and may be comprised of a variety of materials. The bristles may be either round or flat semirigid wires. The bristles and their points may be sharpened so as to enhance their scraping and chopping capabilities. The bristles may be made of metal or plastic materials.

What is claimed is:

1. An article of manufacture, comprising:

a. a handle;

b. a shovel blade having a leading edge and a trailing edge and having said handle rigidly attached to said trailing edge;

c. a bristle holder having semirigid bristles suitable for cutting ice rigidly attached to the underside of said shovel blade substantially parallel to the leading edge of said shovel blade and a suitable distance behind the leading edge of said shovel blade so that said semirigid bristles serve three distinct functions, first as a fulcrum for first class lever action between said handle and said leading edge of said shovel blade to control the height of said leading edge by changing the height of said handle, for scooping up the material being shovelled and avoiding surface irregularities, second, as an ice and snow scraper when said shovel blade is pushed along the surface to be cleared having said semirigid bristles in contact with the surface, and third, as an ice chopper when said shovel blade is raised and lowered substantially perpendicularly to the surface having the ice to be chopped, where the semirigid bristles serve as ice choppers.

2. An article of manufacture as described in claim 1 wherein said bristles are connected to said bristle connecting means by means of a bristle holder.

3. An article of manufacture as described in claim 2 wherein said bristle holder is connected to said shovel blade by bristle connecting means which go through the body of said shovel blade.

4. An article of manufacture as described in claim 2 wherein said bristle holder is connected to said shovel blade by an intermediate plate having means for clamping onto said shovel blade.

5. An article of manufacture as described in claim 1 wherein said means for connecting said bristles to said shovel blade go through the body of said shovel blade.

6. An article of manufacture as described in claim 1 wherein said means for connecting said bristles to said shovel blade is an intermediate plate which fits around said shovel blade.

7. An article of manufacture as described in claim 6 wherein said intermediate plate fits over the leading edge of said shovel blade and is secured to said shovel blade by a clamping means at the lower side of said shovel blade.

8. An article of manufacture as described in claim 6 wherein said intermediate plate fits over the outer edges of said shovel blade and is secured to said shovel blade by clamping means at the outer edges of said shovel blade.

9. A shovel blade attachment, comprising:

a. a bristle holder having semirigid bristles suitable for cutting ice, said bristle holder being rigidly attachable by clamping means to the underside of a shovel blade, a suitable distance behind the leading edge, the shovel blade having a handle rigidly attached to its trailing edge;

b. clamping means which clamp the shovel blade and said bristle holder together thereby exerting clamping pressure on both the upper and lower surfaces of the shovel blade, thereby fixing the position of the bristle holder on the shovel blade so that said semirigid bristles serve three distinct functions, first, as a fulcrum for first class lever action between the shovel blade handle and the leading edge of the shovel blade to control the height of the leading edge of the shovel blade by changing the height of the shovel blade handle, for scooping up the material being shovelled and avoiding surface irregularities, second, as an ice and snow scraper when the shovel blade is pushed along the surface to cleared having said semirigid bristles in contact with the surface, and third, as an ice chopper when the shovel blade is raised and lowered substantially perpendicularly to the surface having the ice to be chopped, where said semirigid bristles serve as ice choppers.

10. A shovel blade attachment as described in claim 9 wherein said intermediate plate supporting said bristles is clamped to the outer edges of the shovel blade by clamping means.

11. A shovel blade attachment, comprising:

a. bristles; and b. means for attaching said bristles to an intermediate plate wherein in addition to said intermediate plate supporting said bristles, also called the first intermediate plate, there is a second intermediate plate; said first intermediate plate has its forward end folded in order to fit over the leading edge of the shovel blade; the rearward end of said first intermediate plate is clamped by clamping means to the forward end of said second intermediate plate whose rearward edge is folded in order to fit over the trailing edge of the shovel blade.

* * * * *